US007588218B2

(12) United States Patent
Kim

(10) Patent No.: US 7,588,218 B2
(45) Date of Patent: Sep. 15, 2009

(54) HEIGHT ADJUSTING APPARATUS AND HOUSEHOLD ELECTRIC APPLIANCE PROVIDED WITH THE SAME

(75) Inventor: Won Tae Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/898,162

(22) Filed: Jul. 26, 2004

(65) Prior Publication Data

US 2005/0103966 A1 May 19, 2005

(30) Foreign Application Priority Data

Nov. 17, 2003 (KR) ..... 10-2003-0081248

(51) Int. Cl.
*F16M 11/24* (2006.01)

(52) U.S. Cl. ..... 248/188.4; 248/176.3; 248/188.8

(58) Field of Classification Search ..... 248/188.2, 248/188.4, 188.5, 188.8, 677
See application file for complete search history.

(56) References Cited

U.S. PATENT DOCUMENTS 1,886,112 A * 11/1932 Luarde ..... 248/188.4
2,327,050 A * 8/1943 Kotler ..... 248/188.4
4,632,356 A * 12/1986 Munz ..... 248/638
4,752,056 A * 6/1988 Culbertson ..... 248/188.9
5,641,139 A * 6/1997 Miller et al. ..... 248/188
5,688,287 A * 11/1997 Cline ..... 5/310
5,732,913 A * 3/1998 Shin ..... 248/188.2
5,881,979 A * 3/1999 Rozier et al. ..... 248/188.5
5,967,472 A * 10/1999 Wilhelmstatter et al. . 248/188.4
6,407,351 B1 * 6/2002 Meyer et al. ..... 177/238
6,533,238 B2 * 3/2003 Barnes et al. ..... 248/680
6,629,506 B2 * 10/2003 Park ..... 108/156

FOREIGN PATENT DOCUMENTS

AU A-97055/98 1/1999
KR 10-271737 8/2000

* cited by examiner

*Primary Examiner*—J. Allen Shriver
*Assistant Examiner*—Steven Marsh
(74) *Attorney, Agent, or Firm*—Staas & Halsey LLP

(57) ABSTRACT

A height adjusting apparatus to expand a height adjustment range of a household electric appliance, and the household electric appliance provided with the height adjusting apparatus. The height of a main body of the household electric appliance provided with the height adjusting apparatus is adjusted using support members installed at a base of the main body and support legs connected to the support members, thereby highly expanding the height adjustment range of the main body.

13 Claims, 5 Drawing Sheets

HEIGHT ADJUSTING APPARATUS AND HOUSEHOLD ELECTRIC APPLIANCE PROVIDED WITH THE SAME

CROSS-REFERENCE TO RELATED APPLICATION

This application claims the benefit of Korean Patent Application No. 2003-81248, filed Nov. 17, 2003 in the Korean Intellectual Property Office, the disclosure of which is incorporated herein by reference.

BACKGROUND OF THE INVENTION

1. Field of the Invention

The present invention relates to a height adjusting apparatus for household electric appliances and a household electric appliance provided with the same, and more particularly, to a height adjusting apparatus to expand a height adjustment range of a household electric appliance, and a household electric appliance provided with the height adjusting apparatus.

2. Description of the Related Art

Generally, a household electric appliance, such as a washing machine or a refrigerator, comprises a main body, and a height adjusting apparatus installed at a base of the main body, to adjust a height of the appliance to satisfy installation circumstances. Such a height adjusting appliance includes connection holes respectively formed through corners of the base and is provided with internal threads formed thereon. Support legs are respectively screwed to the connection holes. Each of the support legs includes a leg portion inserted into the corresponding one of the connection holes and is provided with an outer thread formed on the outer circumference thereof, and a head portion seated on the base around the corresponding one of the connection holes.

The height of the main body of the household electric appliance provided with the above height adjusting appliance is adjusted by adjusting a distance between the base and an installation surface by rotating the support legs, which are respectively screwed into the connection holes.

Since the above conventional height adjusting appliance for the household electric appliance is constructed such that the height of the main body is adjusted by rotating the support legs screwed into the base, the height adjustment range of the main body is limited to the length of the support legs, thus causing a problem in that the height adjustment range of the main body cannot be increased more than the length of the support legs, or be decreased to less than a length of the head portions of the support legs.

SUMMARY OF THE INVENTION

Therefore, an aspect of the invention is to provide a height adjusting apparatus to expand a height adjustment range of a household electric appliance, and the household electric appliance provided with the height adjusting apparatus.

In accordance with one aspect, the present invention provides a height adjusting apparatus for a household electric appliance including a main body with a base, the height adjusting apparatus comprising: support legs positioned between the base of the main body and an installation surface; and support members installed on the base, each of the support members including a leg connection portion receiving a corresponding one of the support legs, wherein installation orientations of the support members on the base are modified to vary a height of the leg connection portions with respect to the installation surface.

According to one aspect, the installation orientations of the support members on the base are converted so that the leg connection portions are positioned on one of an internal surface and an external surface of the base.

According to one aspect, each of the support members includes a base connection portion supported on the base, and a protrusion protruding from the base connection portion, the leg connection portion being connected to an end thereof, wherein the base has a through hole corresponding to an installation position of each support member, through which the corresponding protrusion is selectively inserted, and one of first and second surfaces of the base connection portion is selectively supported on the base so that the leg connection portion is positioned on one of the internal and external surfaces of the base.

According to one aspect, the base connection portion is supported on the external surface of the base.

According to one aspect, the support members are detachably connected to the base, and the support legs are detachably connected to the corresponding support members.

According to one aspect, the height of the main body is adjusted by the support legs.

According to one aspect, each of the leg connection portions has a connection hole, and each of the support legs includes a leg portion inserted into a corresponding one of the connection holes, and a head portion seated on the outer circumference of the connection hole; an inner circumference of the connection hole has an internal thread, and an outer circumference of the leg portion has an external thread, to adjust the height of the main body by the rotation of the support legs.

According to one aspect, the outer diameter of the head portion is less than an inner diameter of the protrusion.

According to one aspect, a length of the head portion is greater than a length of the protrusion.

In accordance with another aspect, the present invention provides a household electric appliance provided with a height adjusting apparatus, the appliance comprising: a main body; a base provided on the main body; support legs positioned between the base and an installation surface; and support members installed on the base, each of the support members including a leg connection portion receiving the corresponding one of the support legs, wherein installation orientations of the support members on the base are converted to vary a height of the leg connection portions with respect to the installation surface.

According to one aspect, the household electric appliance is a drum-type washing machine.

According to one aspect, the household electric appliance is a drum-type clothes dryer.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
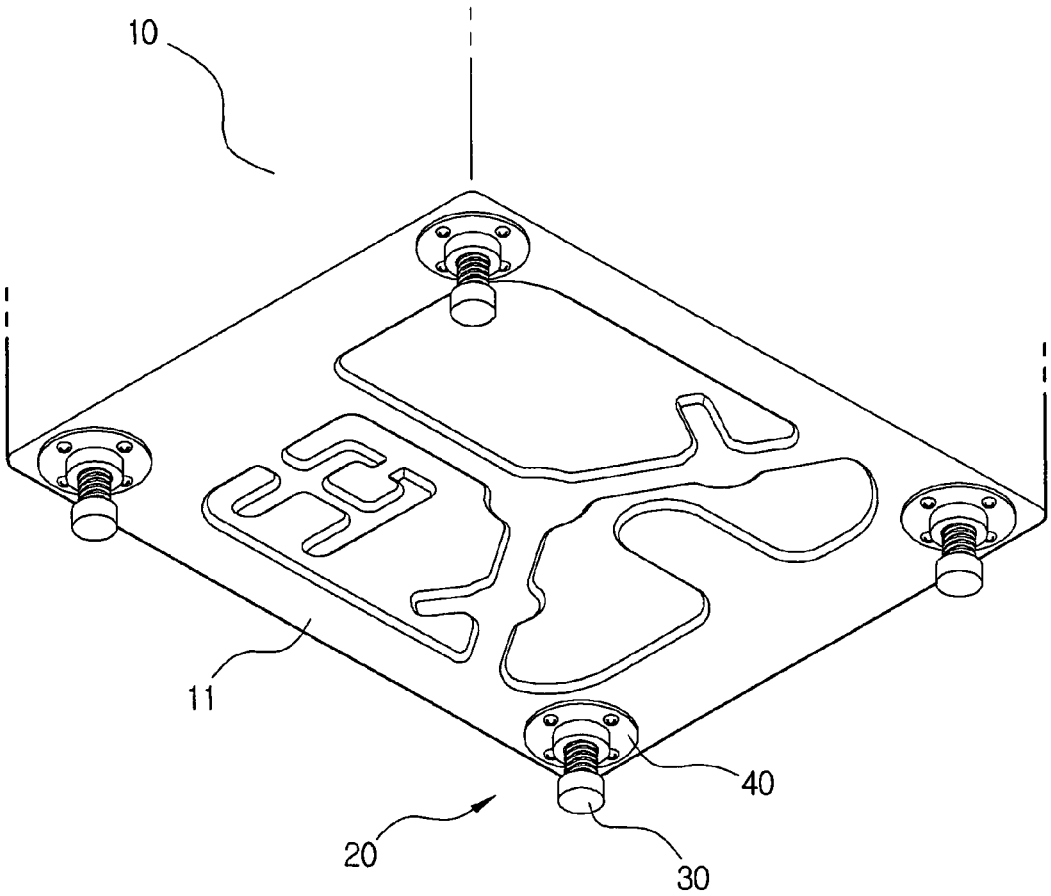
FIG. 1 is a perspective view illustrating a part of a household electric appliance provided with a height adjusting apparatus in accordance with an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

As is shown in FIG. 1, a household electric appliance provided with a height adjusting apparatus in accordance with an embodiment of the present invention comprises a main body 10 defining an appearance thereof, and a height adjusting apparatus 20 positioned between a base 11 of the main body 10 and an installation surface, for both supporting the main body 10 and adjusting the height of the main body 10.

The height adjusting apparatus 20 includes support legs 30 positioned between the base 11 of the main body 10 and the installation surface. The height adjusting apparatus 20 further includes support members 40 installed at the base 11 to connect the support legs 30 thereto. The height of the main body 10 is adjusted by the support legs 30 and the support members 40.

Figure 2:
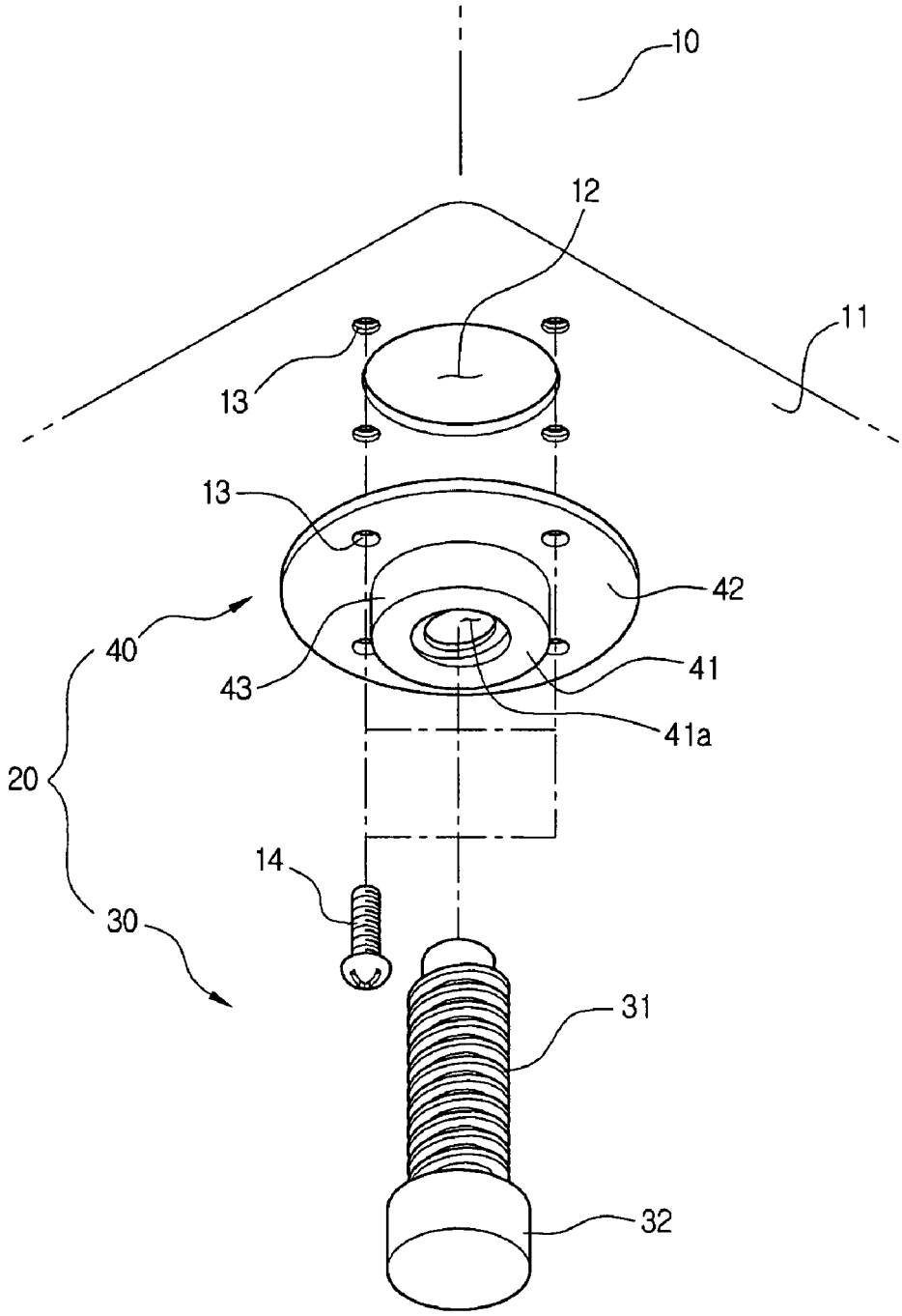
FIG. 2 is an exploded perspective view of the height adjusting apparatus of FIG. 1.

As is shown in FIG. 2, the support legs 30 are detachably connected to the support members 40. Each of the support members 40 includes a leg connection portion 41 provided with a connection hole 41*a* to receive the support legs 30. Each of the support legs 30 includes a leg portion 31 inserted into the connection hole 41*a*, and a head portion 32 seated on the leg connection portion 41. To adjust the height of the main body 10 using the support legs 30, internal threads are formed on inner circumferences of the connection holes 41*a*, and external threads are formed on outer circumferences of the leg portions 31 of the support legs 30. Accordingly, when the support legs 30 are rotated in one direction, once the leg portions 31 of the support legs 30 are screwed into the connection holes 41*a*, the support legs 30 come out of the support member 40 by a designated distance, thereby allowing the main body 10 to have an increased height. On the other hand, when the support legs 30 are rotated in the opposite direction, the support legs 30 enter into the support member 40 by a designated distance, thereby allowing the main body 10 to have a decreased height.

Since the leg portions 31 of the support legs 30 are prepared to have a designated length, when the support legs 30 are continuously rotated in the direction that the height of the main body 10 is increased, the leg portions 31 of the support legs 30 come out of the connection holes 41*a* and the support legs 30 are separated from the support members 40. On the other hand, when the support legs 30 are continuously rotated in the direction that the height of the main body 10 is decreased, the head portions 32 of the support legs 30 are seated on the leg connection portions 41 around the connection holes 41*a*, so that the height of the main body 10 is not further decreased.

The base 11 further includes through holes 12. The through holes 12, having a predetermined size, are positioned at corners of the base 11 of the main body 10. The support members 40 provided with the support legs 30 connected thereto are detachably attached to the base 11 so that the through holes 12 are covered with the support members 40. The support members 40 are designed such that the heights of the leg connection portions 41 vary, thereby allowing the height of the main body 10 to be adjusted independent of the movement of the support legs 30.

Hereinafter, a structure of the support member 40 and a height adjusting function of the main body 10 using the support member 40 will be described in detail.

A base connection portion 42 is formed in an annular shape around the edge of the support member 40, and is provided on each of the support members 40. A plurality of holes 13 to screw the support members 40 to the base 11 are positioned on the base connection portions 42 and corresponding portions of the base 11 around the through hole 12. Accordingly, screws 14 are screwed into the holes 13 when the base connection portions 42 of the support members 40 are supported on the external surface of the base 11, so that the holes 13 positioned on the base connection portions 42 coincide with the holes 13 formed through the base 11, thus connecting the support members 40 to the base 11. According to one aspect, the support members 40 can be connected to the base 11 even when the base connection portions 42 are inverted.

Figure 3:
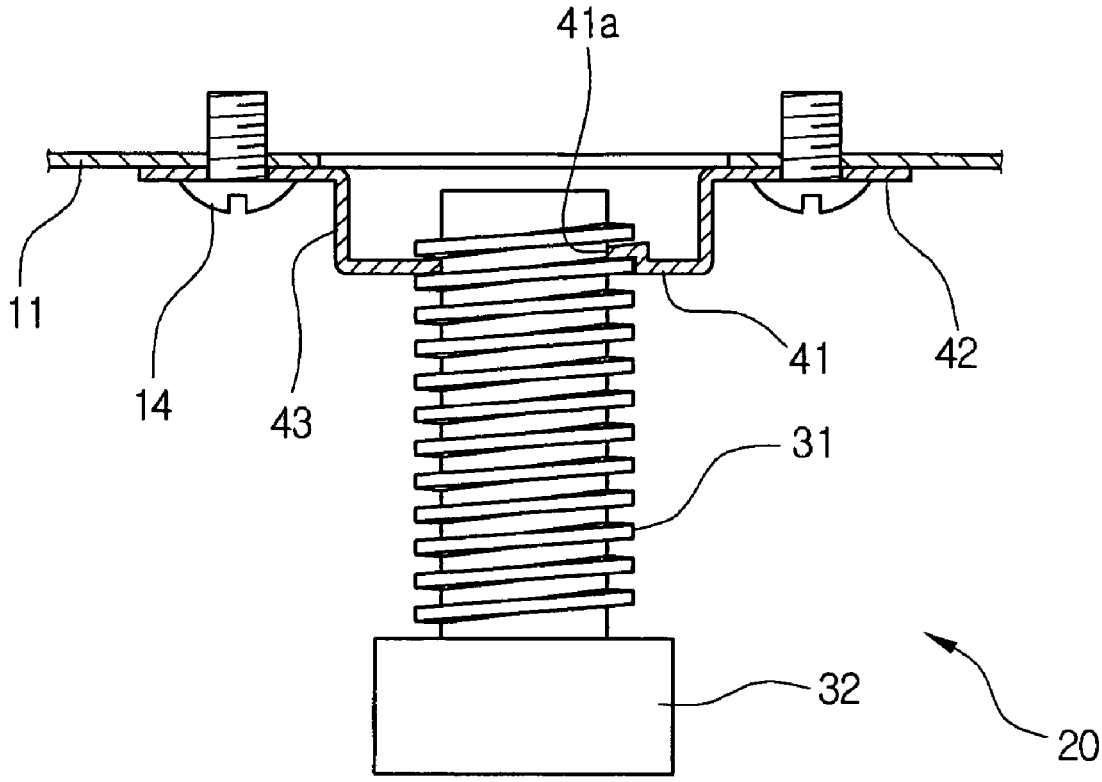
FIG. 3 is a cross-sectional view of the height adjusting apparatus of FIG. 1, in which a support member is in an installation position.
Figure 4:
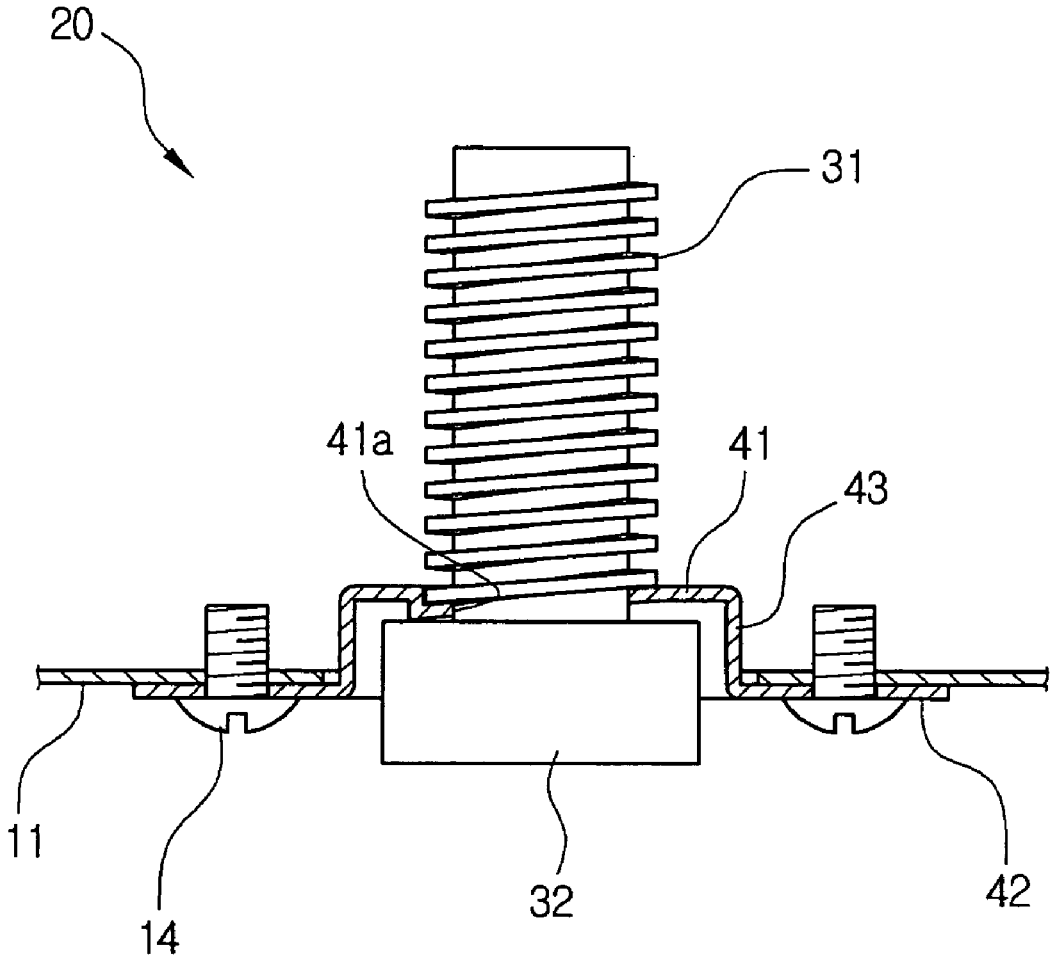
FIG. 4 is a cross-sectional view of the height adjusting apparatus of FIG. 1, in which the support member is in another installation position.

Each of the support members 40 further includes a protrusion 43 formed integrally with the base connection portion 42, and each of the through holes 12 is positioned such that the protrusion 43 can be inserted into the through hole 12. As is shown in FIG. 3, when an upper surface of the base connection portion 42 of the support member 40 is supported on the external surface of the base 11, the protrusion 43 protrudes from the support member 40 toward the lower part of the through hole 12. On the other hand, as is shown in FIG. 4, when a lower surface of the base connection portion 42 of the support member 40 is supported on the external surface of the base 11, the protrusion 43 protrudes from the support member 40 toward an upper part of the through hole 12. The leg connection portion 41, on which the support leg 30 is seated, is positioned at the end of the protrusion 43.

Accordingly, when the support members 40 are installed on the base 11 such that the protrusions 43 protrude through the through hole 12, as is shown in FIG. 4, the leg connection portions 41 are positioned on the upper surface of the base 11, and the height of the main body 10 is decreased. On the other hand, when the support members 40 are installed on the base 11 such that the protrusions 43 are positioned under the through hole 12, the leg connection portions 41 are positioned on the lower surface of the base 11, and the height of the main body 10 is increased, as is shown in FIG. 3. Thereby, it is possible to adjust the height of the main body 10 by reorienting the support members 40.

The above-described height adjusting apparatus of the present invention adjusts the height of the main body 10 using the support members 40 as well as the support legs 30, thus being effectively employed by household electric appliances requiring the main body 10 having a height in a broad adjustment range.

That is, as is shown in FIG. 3, when the support legs 30 are inserted into the connection holes 41*a* of the support members 40 when the support members 40 are connected to the external surface of the base 11, such that the protrusions 43 protrude from the support members 40 toward the lower parts of the through holes 12. Thus, the base 11 is separated from the installation surface by the total sum of the length of the support legs 30 outwardly extended from the support members 40 and the length of the protrusions 43. As such, the height of the main body 10 is allowed to be increased more than the maximum extension length of the support legs 30.

Further, as is shown in FIG. 4, when the support legs 30 are inserted into the connection holes 41*a* of the support members 40 when the support members 40 are inverted, and are then connected to the external surface of the base 11, the protrusions 43 protrude from the support member 40 toward the upper parts of the through holes 12, and are rotated such that the head portions 32 of the support legs 30 are located within the protrusions 43. Thus, the height of the main body 10 is adjusted to be decreased so that the leg portions of the support legs 30 are entirely positioned within the main body 10.

According to one aspect, the base connection portions 42 of the support members 40 can be supported on the internal surface of the base 11. But, to easily convert the orientation of the support members 40 after the assembly of the main body 10 of the household electric appliance, or during the use of the household electric appliance, it is preferable that the base connection portions 42 of the support members 40 are supported on the external surface of the base 11.

According to one aspect, an outer diameter of the head portion 32 of the support leg 30 is smaller than an inner diameter of the protrusion 43 of the support member 40. Thus, an upper portion of the head portion 32 of the support leg 30 is positioned in the protrusion 43 when the protrusion 43 protrudes from the support member 40 toward the upper part of the through holes 12, allowing the distance from the base 11 to the installation surface to be adjusted to less than a length of the head portion 32 of the support leg 30. Further, according to one aspect, the length of the head portion 32 of the support leg 30 is greater than a length of the protrusion 43 of the support member 40, so that the main body 10 is supported on the installation surface through the support legs 30 even when the height of the main body 10 is maximally decreased.

The above-described height adjusting apparatus 20 can be applied to general household electric appliances, such as a washing machine, a clothes dryer, a refrigerator, ovens, or other large or small devices for which leveling or adjustment relative to the surface is required. Additionally, the apparatus 20 can be used in non-appliances, such as furniture. Further, the apparatus 20 can be used in legs or supports for a shelving system. But the apparatus 20 can be effectively applied to certain household electric appliances, which are used independently or stacked on other appliances, such as a drum-type washing machine or a drum-type clothes dryer. Hereinafter, a drum-type washing machine and a drum-type clothes dryer, respectively applying the height adjusting appliance 20, will be described in detail, by way of example.

Figure 5:
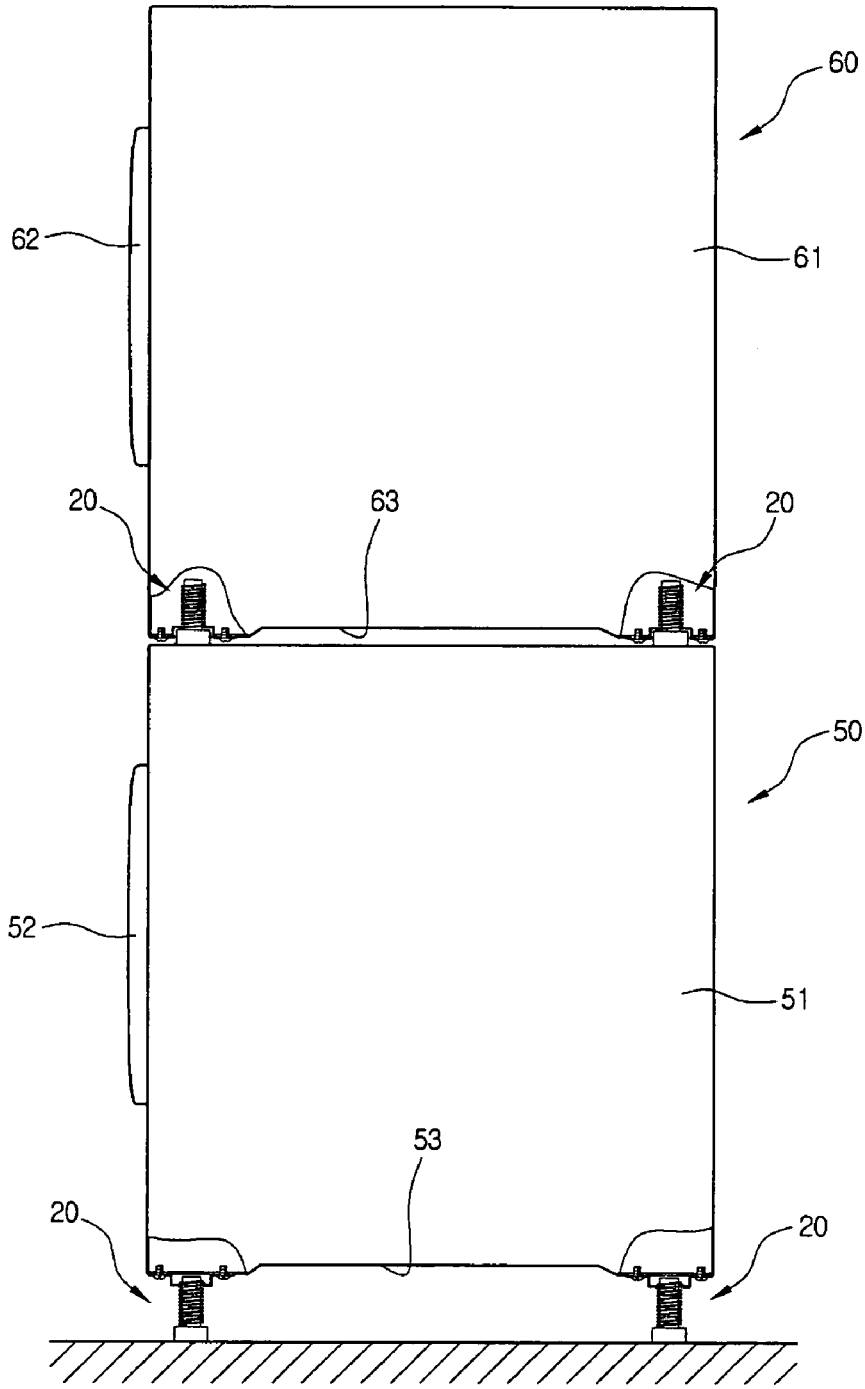
FIG. 5 is a side view of a stack structure of a lower drum-type washing machine and an upper drum-type drying machine, respectively applying the height adjusting apparatus of FIG. 1.

FIG. 5 is a side view of a stack structure of a lower drum-type washing machine and an upper drum-type clothes dryer respectively applying the height adjusting apparatus 20 in accordance with an embodiment of the present invention.

As is shown in FIG. 5, the conventional drum-type washing machine 50 and drum-type clothes dryer 60 respectively include main bodies 51 and 61, and doors 52 and 62, respectively installed at front surfaces of the main bodies 51 and 61. The conventional drum-type washing machine 50 and drum-type clothes dryer 60 can be installed independently, or can be stacked to reduce an installation area thereof. When the conventional drum-type washing machine 50 and drum-type clothes dryer 60 are stacked, as is shown in FIG. 5, the clothes dryer 60, having a comparatively light weight, is stacked on the washing machine 50.

The height adjusting apparatus 20 is installed on each of bases 53 and 63 of the respective main bodies 51 and 61. The height adjusting apparatuses 20 of the drum-type washing machine 50 positioned at the lower part, are oriented such that the protrusions 43 are protruded from the support members 40 toward the lower parts of the through holes 12, so that the leg connection portions 41 are positioned on the lower surface of the base 53 and the support legs 30 are maximally extended outwardly from the support members 40.

Accordingly, the main body 51 of the drum-type washing machine 50 positioned at the lower part has an increased height larger than the length of the support legs 30 using the height adjusting apparatus 20, thereby minimizing an inconvenience that a user bends forward to put the laundry into and take the laundry out of the main body 51.

Further, the height adjusting apparatuses 20 of the drum-type clothes dryer 60, positioned at the upper part, are oriented such that the protrusions 43 protrude from the support members 40 toward the upper parts of the through holes 12, so that the leg connection portions 41 are positioned on the upper surface of the base 63 and the support legs 30 are maximally inserted into the support members 40.

Accordingly, the main body 61 of the drum-type clothes dryer 60, positioned at the upper part, is separated from an upper surface of the main body 51 of the washing machine 50 by a distance that is less than the length of the head portions 32 of the support legs 30, thereby allowing the user to easily put the laundry into and take the laundry out of the main body 61 without use of a foothold, footstool, or other elevating device.

Since the above-described height adjusting apparatus 20 for a household electric appliance in accordance with an embodiment of the present invention is constructed such that the height of the main body is adjusted by the support members 40 as well as the support legs 30, the height adjustment range of the main body 10 of the household electric appliance is highly expanded, thus allowing the height adjusting apparatus 20 to be effectively applied to a drum-type washing machine 50 and a drum-type clothes dryer 60 used independently or in a stacked structure.

Although not shown in the drawings, if the height adjusting apparatus 20 of the present invention is applied to the drum-type washing machines 50 arranged in a multiple stack structure or the drum-type clothes dryers 60 arranged in a multiple stack structure, the height adjusting apparatus 20 has the same functions and effects.

Hereinafter, functions and effects of a household electric appliance provided with the height adjusting apparatus 20 of the present invention will be described in detail, together with assembly and operation of the height adjusting apparatus 20.

When the height adjusting apparatus 20 is installed at the household electric appliance to adjust the height of the main body 10 so that the maximum distance between the base 11 and the installation surface is greater than the length of the support legs 30, the holes 13 positioned on the base 11 coincide with the holes 13 positioned on the base connection portions 42 of the support members 40. The support members 40 are positioned on the base 11 around the through holes 12, such that the protrusions 43 protrude from the support members 40 toward the lower parts of the through holes 12, and the support members 40 are fixed to the base 11 by inserting the screws 14 into the holes 13. Thereinafter, the leg portions 31 of the support legs 30 are inserted into the connection holes 41*a* formed through the leg connection portions 41 of the support members 40, thereby allowing the height adjusting apparatus 20 to be completely installed at the household electric appliance. In this state, the height of the main body 10 may be adjusted by rotating the support legs 30 such that the maximum distance between the base 11 and the installation surface is greater than the length of the support legs 30.

If a user then wants to adjust the height of the main body 10 such that the minimum distance between the base 11 and the installation surface is less than the length of the head portions 32 of the support legs 30, the support legs 30 are separated from the support members 40, and the support members 40 are separated from the base 11 of the main body 10. Then, the support members 40 are fixed again to the base 11 such that the protrusions 43 protrude from the support members 40 toward the upper parts of the through holes 12. Thereafter, the leg portions 31 of the support legs 30 are inserted again into the connection holes 41*a* formed through the leg connection portions 41 of the support members 40, and in this state the height of the main body 10 may be adjusted by rotating the support legs 30 such that the minimum distance between the base 11 and the installation surface is less than the length of the head portions 32 of the support legs 30.

As is apparent from the above description, the embodiments of the present invention provides the height adjusting apparatus and the household electric appliance provided with the apparatus, in which the height of the main body 10 of the household electric appliance is adjusted using both the support members 40 installed at the base 11 and connected to the support legs 30, as well as the support legs 30 positioned between the base 11 of the main body 10 and the installation surface, thereby highly expanding the height adjustment range of the main body 10.

While described in terms of adjusting a vertical height, it is understood that the present invention can be used to adjust a relative distance between adjacent sidewalls, to adjust a horizontal distance.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A position adjusting apparatus to adjust a position of a support surface relative to an installation surface, the position adjusting apparatus comprising:

a support leg having a head portion and a leg portion; and a support member, connectable to the support surface in multiple orientations, and having a protrusion having a circumference and adjustably receiving the leg portion, the position of the support surface relative to the installation surface being adjustable to a distance greater than a length of the support leg and to a distance less than a length of the head portion by adjusting the orientation of the support member so that the protrusion protrudes toward or away from the installation surface, wherein the support member includes a leg connection portion receiving the support leg, which is connected to an end thereof and surrounded by the protrusion, and wherein the support member is installed on a base so that the protrusion protrudes either toward an upper side of the base or away from lower side of the base, wherein the support member comprises:

a base connection portion supported on the base, wherein the base has a through hole corresponding to an installation position of the support member, through which the corresponding protrusion is selectively inserted, and one of first or second surfaces of the base connection portion is selectively supported on the base so that the leg connection portion is positioned on one of the internal or external surfaces of the base.

2. The position adjusting apparatus according to claim 1, wherein the base connection portion is supported on the external surface of the base.

3. The position adjusting apparatus according to claim 1, wherein the support member is detachably connected to the base, and the support leg is detachably connected to the corresponding support members.

4. The position adjusting apparatus according to claim 1, wherein the height of the main body is adjusted by the support leg.

5. The position adjusting apparatus according to claim 4, wherein:

the leg connection portion has a connection hole;

the support leg comprises a leg portion inserted into the connection hole, and a head portion seated on the outer circumference of the connection hole;

an inner circumference of the connection hole has an internal thread; and an outer circumference of the leg portion has an external thread, to adjust the height of the main body by the rotation of the support leg.

6. The position adjusting apparatus according to claim 5, wherein an outer diameter of the head portion is less than an inner diameter of the protrusion.

7. The position adjusting apparatus according to claim 5, wherein a length of the head portion is greater than a length of the protrusion.

8. A height adjusting apparatus for a household electric appliance including a main body with a base, the height adjusting apparatus comprising:

at least one support leg positioned between the base of the main body and an installation surface, and at least one support member to height-adjustably support the support leg to the base, the support member including a leg connection portion receiving the support leg, and a protrusion protruding from an outer circumference of the leg connection portion, wherein the base has a through hole through which the protrusion is inserted, and the support member is installed on the base so that the leg connection portion is selectively positioned at an outside of the base or an inside of the base through the through hole, thereby adjusting the height of the main body, wherein;

the leg connection portion has a connection hole, the support leg comprises:

a leg portion inserted into the connection hole, and a head portion seated on an outer circumference of the connection hole, wherein an inner circumference of the connection hole has an internal thread, and an outer circumference of the leg portion has an external thread, to adjust the height of the main body by the rotation of the support leg.

9. The height adjusting apparatus according to claim 8, wherein the support member further includes a base connection portion, and one of first and second surfaces of the base connection portion selectively contacts the outside of the base so that the leg connection portion is positioned on one of the internal and external surfaces of the base.

10. The height adjusting apparatus according to claim 8, wherein an outer diameter of the head portion is less than an inner diameter of the protrusion.

11. The height adjusting apparatus according to claim 8, wherein a length of the head portion is greater than a length of the protrusion.

12. The height adjusting apparatus according to claim 8, wherein the household electric appliance is a drum-type washing machine.

13. The height adjusting apparatus according to claim 8, wherein the household electric appliance is a drum-type clothes dryer.

* * * * *